United States Patent [19]

Rietschle

[11] Patent Number: 4,588,358

[45] Date of Patent: May 13, 1986

[54] ROTARY VANE EVACUATING PUMP

[75] Inventor: Werner Rietschle, Schopfheim, Fed. Rep. of Germany

[73] Assignee: Werner Rietschle Maschinen-und Apparatebau GmbH, Schopfheim, Fed. Rep. of Germany

[21] Appl. No.: 627,193

[22] Filed: Jul. 2, 1984

[51] Int. Cl.[4] ..... F04C 23/00; F04C 29/00

[52] U.S. Cl. ..... 417/247; 417/252; 417/253; 417/360; 418/13; 418/83

[58] Field of Search ..... 418/13, 83; 417/360, 417/247, 252, 253

[56] References Cited

U.S. PATENT DOCUMENTS

| | | | |
|---|---|---|---|
| 1,476,482 | 12/1923 | Berrenberg | 418/13 |
| 1,934,155 | 11/1933 | Van Deventer | 417/360 |
| 2,780,406 | 2/1957 | Feldbush | 418/13 |
| 2,936,949 | 5/1960 | Broom | 418/13 |
| 2,961,151 | 11/1960 | Fobian | 418/13 |
| 3,008,631 | 11/1961 | Paugh | 418/13 |
| 3,713,426 | 1/1973 | Jensen | 418/13 X |
| 3,948,225 | 4/1976 | Lester | 418/13 X |

FOREIGN PATENT DOCUMENTS

| | | | |
|---|---|---|---|
| 20038 | 1/1956 | Fed. Rep. of Germany | 418/13 |
| 958690 | 1/1957 | Fed. Rep. of Germany | 418/13 |
| 136761 | 7/1979 | German Democratic Rep. | 417/247 |

*Primary Examiner*—Carlton R. Croyle
*Assistant Examiner*—Theodore W. Olds
*Attorney, Agent, or Firm*—Frost & Jacobs

[57] ABSTRACT

A rotary vane evacuating pump having two series connected pumping stages is disclosed. Each pumping stage is provided as an exchangeable unit and has a housing which is detachably connected to one face of an interface flange. The housings of the pumping stages are contained in a chamber defined between the interface flange and an outer shell which is detachably mounted thereto. The chamber is filled with water surrounding and contacting the two housings. Each pumping stage is readily dismantled for the purpose of service or replacement.

15 Claims, 5 Drawing Figures

Fig.1
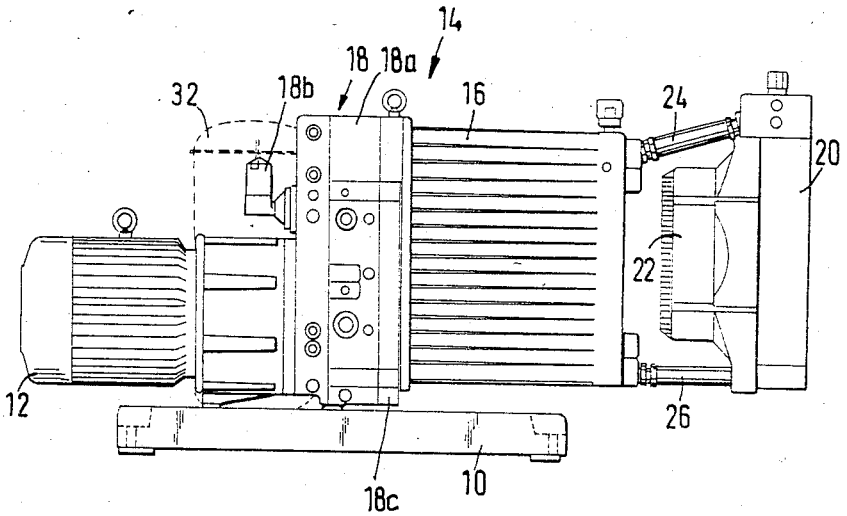
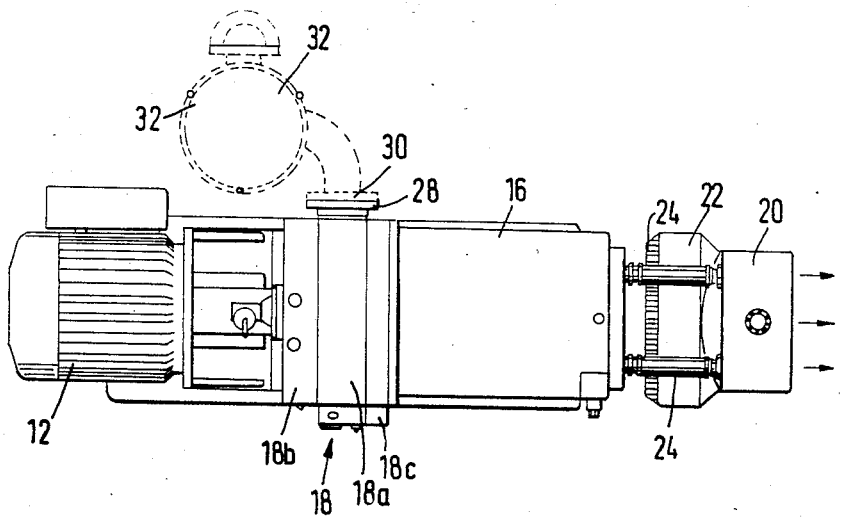
Fig.2

Fig.3
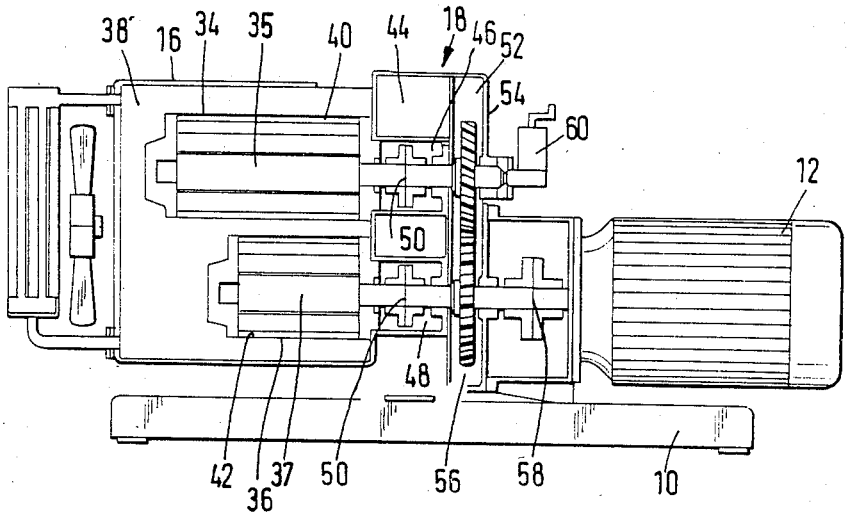
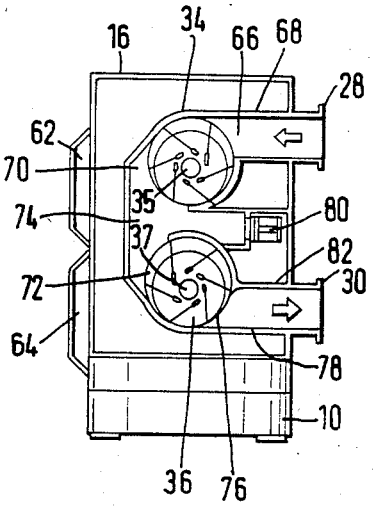
Fig.4

ROTARY VANE EVACUATING PUMP

BACKGROUND OF THE INVENTION

This invention relates to a rotary vane evacuating pump of the type having at least one pumping stage which is cooled by a cooling fluid such as water surrounding the cylindrical sleeve of the pumping stage.

Conventional rotary vane evacuating pumps of this type are provided with a water jacket defined between the outside of the cylindrical sleeve wherein the rotor of the pump is received and an outer housing spaced from the sleeve and surrounding the same. The sleeve and the outer housing are generally integrally formed by casting techniques.

Rotary vane evacuating pumps are commonly used in the fields of chemical and pharmaceutical industries for purposes such as distillation, drying and fractionating, as well as for varying purposes in the plastics, ceramic and packaging industries. These pumps are often exposed to aggressive and corrosive fluids causing a deterioration of the pump performance after prolongated operation. In chemical processes, for example, the pump performance may become unsatisfactory after a continuous operation for about one year or even less, requiring the pump to be serviced or replaced. While a replacement of the pump is the easiest manner to restore the operativeness of the implement to which the pump belongs, it is also the most expensive one. In fact, the conventional rotary vane evacuating pumps are rather expensive, due to the complicated structure and shape of the pump housing which is required to incorporate a cooling water jacket. The production of these pump housings requires complex and expensive casting techniques to be applied. On the other hand, a replacement of the worn parts of the pump requires considerable time for dismantling the pump housing, disassembling the worn parts and reassembling the whole pumping unit. Prolongated shutoff times can hardly be tolerated in many chemical processes.

It is, therefore, a primary object of the invention to provide an improved rotary vane evacuating pump having at least one pumping stage provided as a readily exchangeable unit.

It is a further object of the invention to provide an improved rotary vane evacuating pump having two series connected pumping stages each of which is provided as a readily exchangeable unit.

A still further object of the invention is to provide an improved pumping stage for a rotary vane evacuating pump, the pumping stage being reduced to the basic active parts of a rotary vane pump so that complete pumping stages can be economically provided as spare parts for replacement of used pumping stages.

Other objects and advantages of the present invention will become apparent as the description proceeds.

SUMMARY OF THE INVENTION

In accordance with the present invention, a rotary vane evacuating pump is provided which comprises at least one pumping stage and preferably two pumping stages each having a rotor received in a generally cylindrical bore of a housing and carrying vanes cooperating with the cylindrical bore. The housing of each pumping stage is exposed to a cooling fluid circulating in a cooling system. Each pumping stage is provided as an exchangeable unit and has its housing detachably mounted to one face of an interface flange. An outer shell is detachably mounted to the same face of the interface flange, and the compartment defined between the outer shell, the interface flange and the housing or housings of the pumping stage or stages is filled with a cooling fluid such as water. The cooling fluid directly contacts the outside of these housings to dissipate the heat produced by operation of the pumping stages. The outer shell can be provided with openings for connection to a heat exchanger completing the cooling system of the pump.

Thus, the basic idea of the invention is to provide each pumping stage as a readily exchangeable unit reduced to the active basic parts of a rotary vane pump which are susceptible to wear and performance deterioration, especially under severe operating conditions such as encountered in many chemical processes. Thus, many of the components required in a complete rotary vane evacuating pump are lodged outside each pumping stage, namely in the interface flange. In preferred embodiments, the interface flange is hollow and lodges passageways for interconnection of two separate pumping stages connected in series to form a two-stage rotary vane evacuating pump.

In accordance with a further preferred embodiment, the hollow interface flange lodges a transmission mechanism provided between a single driving motor and each of the two pumping stages. The transmission mechanism preferably comprises two intermeshing gears one of which is directly driven by the motor and drives the rotor of one pumping stage while the other gear drives the rotor of the other pumping stage.

In a further embodiment of the invention, the interface flange comprises at least one compartment for storing a supply of oil to be fed to particular zones of the pumping stage requiring lubrication. For example, lubrication may be provided for the bearings of the pump rotor and/or the pumping chamber defined between the rotor vanes and the inside of the cylindrical bore wherein the rotor is eccentrically received. Separate oil compartments may be provided for different types of oil for lubrication of different zones of the pumping stage.

Further features and advantages stand out from the following description of a preferred embodiment of the invention with reference to the accompanying drawings.

BRIEF DESCRIPTION OF THE DRAWINGS

FIG. 1 is an elevational side view of a rotary vane evacuating pump according to the invention;

FIG. 2 is a top view of the pump illustrated in FIG. 1;

FIG. 3 is a representation of the same pump showing two pumping stages, a cooling system, an interface flange and a transmission mechanism in a diagrammatic longitudinal section;

FIG. 4 is a similar representation of the same pump, but showing the association of the pumping stages in a diagrammatic transverse section.

Figure 5:
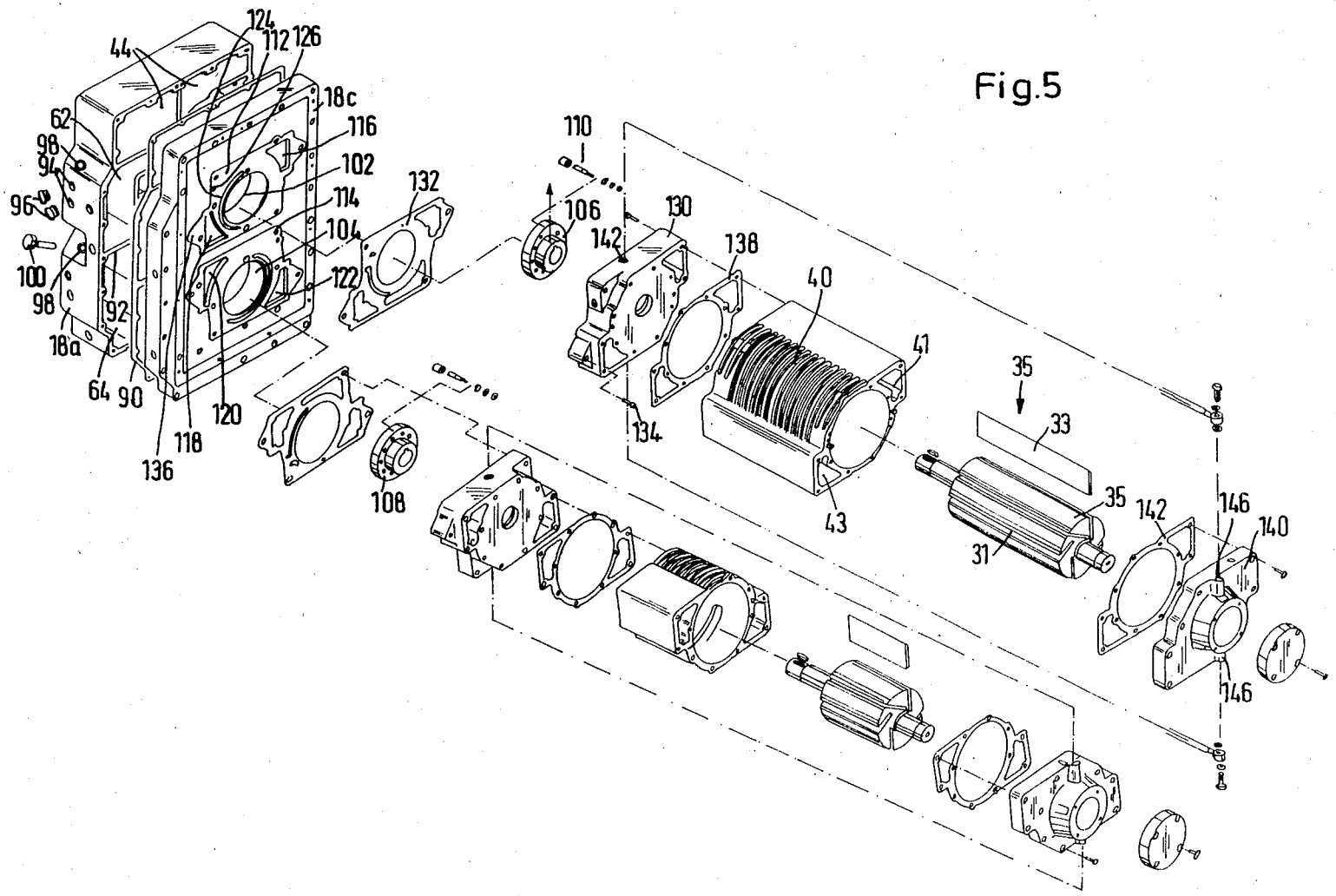
FIG. 5 is an explosive view of the interface flange and the two pumping stages of the pump shown in the preceding Figures.

The rotary vane evacuating pump unit shown in the drawings comprises a base 10 carrying an electric driving motor 12 and a two-stage rotary vane pump generally shown at 14. The pump 14 has an outer shell 16 and a hollow interface flange 18 mounted between the outer shell 16 and the electric motor 12. The outer shell 16 carries a heat exchanger 20 with an associated fan unit 22, the heat exchanger 20 being connected to the compartment defined inside the outer shell 16 through upper tubular conducts 24 and lower tubular conducts 26.

The input and output connections 28, 30 are located on a lateral face of the interface flange 18, as apparent from FIG. 2. In FIGS. 1 and 2, a generally cylindrical oil separator 32 is diagrammatically shown in dotted lines as connected to the output connection 30 of the pump. An oil separator is optionally provided.

As shown in FIGS. 3 and 4, the pump includes two pumping stages 34, 36 flanged to the same face of the interface flange 18 as the outer shell 16. The outer shell 16 and the two pumping stages 34, 36 are detachably mounted, e.g. bolted to the interface flange 18. The compartment 38 defined between the outer shell 16 and the flange 18 is filled with water, the water thus surrounding the housings 40 and 42 of the two pumping stages 34 and 36. The two pumping stages 34, 36 are mounted one above another in mutually spaced relationship. The lower pumping stage 36 is smaller than the upper stage 34.

The flange 18 is composed of a central casing 18*a* and two outer covers 18*b*, 18*c*. The flange 18 is hollow and has cavities, compartments and passageways defined therein. In FIG. 4, a compartment 44 for receiving a supply of oil is shown. The compartment 44 communicates with zones of the pumping stages 34, 36 requiring lubrication, in a manner to be disclosed later in more detail. The flange 18 further comprises two cavities 46, 48 extending axially through the outer covers 18*b*, 18*c* and the casing 18*a* to allow the passage of coupling mechanisms 50 coupling the rotors 35, 37 to a transmission mechanism contained in a separate compartment 52 of the flange 18. The transmission mechanism includes two intermeshing gears 54, 56 of which the gear 56 is directly coupled to the rotor 37 of the lower pumping stage 36 and to the rotor of the electric motor 12 through a coupling mechanism 58, while the upper gear 54 is coupled to the rotor 35 of the upper pumping stage 34 on the one hand and to an oil metering pump 60 on the other hand. The connections of the oil metering pump 60 are not shown for simplicity. The oil metering pump 60 may communicate with the compartment 44 to withdraw oil therefrom and feed a predetermined rate of fresh oil to the pumping chambers defined between the rotor and the cylindrical bore of each pumping stage. The bottom of the compartment 52 is filled with oil for lubrication of the transmission mechanism including the two gears 54, 56. Two further oil compartments 62, 64 are provided one above another inside the flange 18 adjacent one lateral face thereof. The oil compartment 62 communicates with the bearings of the rotor 35 of the upper pumping stage 34 to supply oil thereto under gravity. The compartment 64 communicates with the bearings of the rotor 37 of the lower pumping stage 36 to supply oil thereto under gravity.

As shown in FIG. 4, the two pumping stages 34, 36 are connected in series. Thus, the inlet port 66 of stage 34 communicates with the input connection 28 through a passageway 68 formed within the flange 18. The outlet port 70 of the stage 34 communicates with the inlet port 72 of the stage 36 through a passageway 74 which is also formed within the flange 18. The outlet port 76 of the stage 36 is connected to the output connection 30 through a passageway 78 which is also formed within the hollow flange 18. Finally, an overflow valve 80 is mounted between the passageway 74 and a lateral opening 82 of passageway 78, but the overflow valve 80 is normally biased into a closed position.

It is apparent that each pumping stage 34, 36 is reduced to the basic active parts of a rotary vane pump, i.e. a cylindrical sleeve or housing and the rotor eccentrically mounted therein. In addition, each pumping stage is interfaced to its drive, its input and output connections and its oil supplies through only one lateral side of its housing, all of these connections being simultaneously established by simply flanging the housing of the pumping stage to one face of the interface flange 18.

Specific details relating to the structure of the preferred embodiment are apparent from FIG. 5.

In FIG. 5, the interface flange 18 and the two pumping stages 34, 36 are shown in an explosive view. Of the interface flange 18, only the casing 18*a* and the cover 18*c* are shown. A seal 90 is provided between casing 18*a* and cover 18*c*. The hollow space within the casing 18*a* is partitioned into cavities and compartments by partition walls. For example, the oil compartments 64, 62 are separated by a partition wall 92. The oil level within the oil compartments 62, 64 may be checked through inspection bores 94 closed by transparent plugs 96, and oil may be filled in through filler openings 98 closed by a removable plug 100.

The cover 18*c* has two cylindrical cavities 102, 104 through which the two coupling mechanisms 50 may extend. On the side of the rotors 35,37 this coupling mechanism comprises a circular flange 106, 108 locked on the corresponding end of the associated rotor shaft and provided with axially projecting studs 110 which are equally spaced along the periphery of the corresponding circular flange. The studs 110 are adapted to be received in mating bores of a similar circular flange coupled to the corresponding one of the gears 54, 56, as shown in FIG. 3.

On its face directed towards the pumping stages, the cover 18*c* forms planar flanges 112, 114 having various passageways extending therethrough. Flange 112 has an opening 116 communicating with the inlet passageway 68 (FIG. 4) and an opening 118 communicating with the passageway 74 and through the latter with an opening 120 of the flange 114. Flange 114 has a further opening 122 communicating with the outlet passageway 78 (FIG. 4). The oil compartments 44, 62 and 64 communicate with various openings formed in the flanges 112, 114. Thus, chamber 62 communicates with an arcuately shaped groove 124 of flange 112, and an opening 126 of flange 112 communicates with an outlet of the metering pump 60.

The upper pumping stage 34 has a housing 40 closed on one of its ends by a mounting flange 130 mating with flange 112 and having corresponding openings and passages extending therethrough. Between flange 112 and mounting flange 130, a seal 132 is provided having openings formed therethrough corresponding to the various openings extending through flange 112. Mounting flange 130 is detachably secured against flange 112 by bolts such as 134 engaged into tapped holes 136 formed in flange 112. A further seal 138 is provided between mounting flange 130 and the corresponding end of housing 40. The opposed end of housing 40 is closed by a cover 140 with a seal 132 being interposed therebetween. The rotor 35 carries a plurality of vanes 33 slidingly received in grooves 31, just as in a conventional rotary vane pump.

The housing 40 has an inlet conduct 41 and an outlet conduct 43 extending generally axially along and outside of the cylindrical sleeve of the housing 40 wherein the rotor 35 is received. Each conduct 41, 43 communicates through openings radially formed through the cylindrical sleeve of housing 40 into the pumping chamber defined between the inside of the sleeve and the rotor 35. At their ends adjacent cover 140, the conducts 41, 43 are closed thereby. At their opposed ends adjacent the mounting flange 130, these conducts communicate with corresponding openings formed therethrough in registration with openings 116, 118 of flange 112.

The bearings (not shown) of the rotor 35 are received in cavities of mounting flange 130 and cover 140, respectively, each of these cavities communicating with oil groove 124 formed in flange 112. While the communication between oil groove 124 and the bearing cavity of mounting flange 130 is a direct communication through seal 132, the communication with the bearing cavity of cover 140 is established through opening 142 extending radially through mounting flange 130 and communicating with the bearing cavity formed therein (only one of these openings 142 being shown) and corresponding openings 146 communicating with the bearing cavity of cover 140 through oil bores radially extending therethrough.

The second, lower pumping stage and its associated flange 114 are of basically similar structure and will therefore not be disclosed in detail.

In operation, the rotors 35 and 37 are driven in opposite directions by the electric motor 12 and through the intermeshing gears 54, 56. The rotational speeds of the rotors 35 and 37 may be equal or different, as required by the particular conditions under which the pump is to be operated. As the lower pumping stage 36 is smaller than the upper stage 34 and thus has a smaller capacity, the lower stage is advantageously bypassed by overflow valve 80 in the initial evacuating phase, the overflow valve 80 responding to a reverse pressure differential between passageways 74 and 78.

The heat developed by the continuous operation of the pump is dissipated from the housings 40, 42 of the two pumping stages by the water surrounding them and contained within compartment 38. As seen in FIGS. 3 and 4, both pumping stages are mounted one above another and in mutally spaced relationship, the smaller stage 36 being mounted below the larger stage 34. Under these conditions, an unobstructed convection flow of the water will automatically occur within the compartment 38 along the outer surfaces of the housings 42 and 40 towards the tubular conducts 24, through the heat exchanger 20, through the tubular conducts 27 and back to the bottom of the compartment 38. There is no need for forced positive circulation of the cooling water, whereby the cooling system is considerably simplified.

Under severe conditions of use such as the evacuation of corrosive or aggressive media, the performance of the pump may become insufficient due to corrosion and wear of the active parts of the pump. In that case, one of the pumping stages 34, 36 or both are easily dismantled and replaced by simply withdrawing the water from chamber 38, removing the outer shell 16 from the cover 18*c* of the interface flange 18, unscrewing the bolts 134 and pulling the housing 40 or 42 with its associated mounting flange away from the interface flange 18, exchanging the defective stage against a new one and finally replacing and securing the outer shell 16 on the cover 18*c* of the interface flange 18. Having refilled chamber 38 with water, the pump is ready for operation. These operations can be accomplished in a short time and require no particularly qualified service personnel.

An important advantage of the invention is the fact that the housing of each pumping stage has a very simple shape and structure and requires no complex and expensive casting techniques. Thus, each pumping stage is a relatively inexpensive unit, and a pump can be supplied with a set of spare pumping units without causing major additional expenses.

What is claimed is:

1. A rotary vane fluid evacuating pump comprising at least one pumping stage including a rotor received in a generally cylindrical bore of a housing and carrying vanes cooperating with said cylindrical bore, said housing including fluid inlet and outlet ports and lubrication oil inlet and outlet connections;

motor means having a driving member for rotationally driving said rotor of said pumping stage within said housing;

coupling means for detachably interconnecting said rotor and said driving member;

a cooling system including means for defining a cooling liquid flow along at least a portion of said housing; and an interface flange having at least one face and a plurality of internal fluid passages, said housing including a mounting flange for mounting said housing on said one interface flange face, said mounting flange including a plurality of internal passageways providing fluid communication between the fluid ports and lubricating oil connections of the housing and corresponding fluid passages in the interface flange; and an outer shell detachably mounted to said one face of said interface flange;

wherein said pumping stage is provided as an exchangeable unit, said housing being detachably mounted to said one face of said interface flange and being contained in a chamber defined between said interface flange and said outer shell, said chamber being at least partially filled with said cooling liquid and said cooling liquid surrounding and contacting at least a substantial portion of said housing, whereby said housing is cooled by the cooling liquid and said housing inlet and outlet ports and said housing lubrication oil inlet and outlet connections extend through said mounting flange and to communicate with associated passageways formed in said interface flange.

2. The rotary vane evacuating pump of claim 1 wherein said interface flange has two opposed major faces and said housing of said pumping stage is mounted on one of said faces while said motor means are mounted on the other of said faces, said coupling means extending through said interface flange.

3. The rotary vane evacuating pump of claim 1 wherein said interface flange defines at least one compartment for storing a supply of lubrication oil and connected to a zone to be lubricated of said pumping stage by an oil passageway extending through said one face of said interface flange and an adjacent face of said housing.

4. The rotary vane evacuating pump of claim 3 wherein said interface flange defines two separate compartments for storing supplies of lubrication oil and connected to different zones to be lubricated of said pumping stage, one of said zones including bearings of said rotor in said housing and the other of said zones being formed between said vanes and said cylindrical bore.

5. The rotary vane evacuating pump of claim 1 and comprising two series connected pumping stages each having its own housing and rotor and each being provided as said exchangeable unit and mounted to the same face of said interface flange.

6. The rotary vane evacuating pump of claim 5 wherein said pumping stages are mounted one above another in mutually spaced relationship.

7. The rotary vane evacuating pump of claim 6 wherein said pumping stages have differently sized housings and the smaller one of said housings is located beneath the larger one of said housings.

8. The rotary vane evacuating pump of claim 5 wherein a transmission mechanism is provided between said motor means and the rotors of said pumping stages, said transmission mechanism having an input coupled to said motor means and two outputs coupled to said rotors, respectively, and said transmission mechanism being lodged in a compartment of said interface flange.

9. The rotary vane evacuating pump of claim 8 wherein said transmission mechanism includes two intermeshing gears rotationally mounted one above another within said compartment, one of said gears being directly coupled to said motor means and to one of said rotors and the other gear driving the other of said rotors.

10. The rotary vane evacuating pump of claim 5, wherein each pump stage has an inlet and an outlet port formed in its housing and each housing is provided with a radially extending mounting flange for mounting said housings on said interface flange, said inlet ports and outlet ports leading through said mounting flanges and communicating with associated passageways through said interface flange, one of said passageways interconnecting the outlet port of a first one of said pumping stages and the inlet port of a second one of said pumping stages and two further passageways connecting an input connection of said evacuating pump to the input port of said first one of said pumping stages and an output connection of said evacuating pump to the outlet port of said second pumping stage, respectively.

11. The rotary vane evacuating pump of claim 10 wherein said input connection is arranged above said output connection on a lateral face of said interface flange.

12. The rotary vane evacuating pump of claim 1 wherein said coupling means comprise mutually engaging male and female coupling members between said rotor and said driving member.

13. The rotary vane evacuating pump of claim 12 wherein said male coupling member is formed of a flange carrying axially projecting studs and said female coupling member is formed of a flange having openings corresponding in size and distribution to said projecting studs, said projecting studs being adapted to be removably received in said openings.

14. The rotary vane evacuating pump of claim 10, wherein said one passageway and said outlet port of said second pumping stage are bypassed by an overflow valve adapted to establish a direct communication between said one passageway and said port in response to a pressure differential existing therebetween which is opposite to the normal pressure differential caused by operation of said second pumping stage.

15. The rotary vane evacuating pump of claim 1, wherein said coupling means is lodged within said interface flange.

* * * * *